United States Patent [19]

Offermann

[11] Patent Number: 4,704,515

[45] Date of Patent: Nov. 3, 1987

[54] METHOD FOR SUPPLYING ELECTRICAL POWER TO PROXIMITY-EFFECT HEAT-TRACING CIRCUITS

[75] Inventor: Paul F. Offermann, Redwood City, Calif.

[73] Assignee: Chevron Research Company, San Francisco, Calif.

[21] Appl. No.: 830,523

[22] Filed: Feb. 17, 1986

Related U.S. Application Data

[63] Continuation-in-part of Ser. No. 537,994, Sep. 30, 1983, Pat. No. 4,571,487.

[51] Int. Cl.[4] ..... H05B 3/00; H05B 5/00

[52] U.S. Cl. ..... 219/300; 219/301; 307/17; 307/87; 361/45

[58] Field of Search ..... 219/300, 301, 503, 482; 361/57, 45, 87; 307/17, 83; 323/361, 332, 262

[56] References Cited

U.S. PATENT DOCUMENTS

| | | | |
|---|---|---|---|
| 3,523,177 | 8/1970 | Ando | 219/300 |
| 3,632,975 | 4/1975 | Ando et al. | 219/300 |
| 3,983,360 | 9/1976 | Offermann | 219/300 |
| 4,204,407 | 5/1980 | Smith | 219/300 |

*Primary Examiner*—M. H. Paschall

*Attorney, Agent, or Firm*—Burns, Doane, Swecker & Mathis

[57] ABSTRACT

A method for reducing voltages required by in-place proximity-effect circuits includes providing uninsulated conductors which extend from a main transformer station to remote feed-node locations for connection to insulated conductors within a heat-tracing pipe.

8 Claims, 5 Drawing Figures

METHOD FOR SUPPLYING ELECTRICAL POWER TO PROXIMITY-EFFECT HEAT-TRACING CIRCUITS

This application is a continuation-in-part of my earlier co-pending application Ser. No. 537,994, filed Sept. 30, 1983, now U.S. Pat. No 4,571,487.

BACKGROUND OF THE INVENTION

1. Field of the Invention

The present invention generally pertains to the art of heating pipelines and, more particularly, to heat-tracing systems of the proximity-effect type for heating long-distance pipelines.

2. State of the Art

In long-distance pipelines for transporting viscous fluids such as heavy oil and molten sulfur, it is known that flow may be faciliated by heating the fluids to temperatures above ambient. To provide such heating, it is also known to utilize so-called heat-tracing pipes, which run lengthwise in contact with the pipelines. Further, it is known that the heat-tracing pipes can be heated by electrical means to provide conduction of thermal energy to the main pipeline.

A type of electrical heating conventionally used in heat-tracing systems is known as proximity-effect heating. Such heating is accomplished by installing insulated cable which runs lengthwise through the interior of a ferromagnetic heat-tracing pipe for connection to the pipe at a location remote from a source of alternating current connected to the insulated cable. In practice, alternating current sources are located at convenient intervals, usually ranging from a few hundred to a few thousand feet, along pipeline. In the proximity-effect circuits, alternating current flows from the insulated cable into the ferro-magnetic pipe and then returns to the alternating current source through the wall of the pipe. The current through the ferromagnetic pipe, because of electromagnetic induction and other effects, concentrates on the inner surface of the pipe; such current concentration is properly referred to as proximity effect heating, although the term "skin effect" is often applied. Heat is generated in such proximity-effect circuits primarily by electrical resistance (i.e., $I^2R$ losses), but also by magnetic hysteresis and by eddy currents. Temperatures may reach about 300° F. or more in the heat-tracing pipes.

In proximity-effect heating systems, the relationships between heat, current and voltage are generally as follows: for a given heat input per unit length of heat-tracing pipe, a certain current is required; to provide the required current in a branch of the proximity-effect circuit, a voltage must be applied directly proportional to the length of the insulated cable defining the branch. Voltages exceeding several kilovolts are required in practice to provide appreciable heating over long distances. However, voltages which can be safely applied to proximity-effect circuits are limited by the rating of insulated cable utilized in the circuits; that is, voltages in excess of the rating of an insulated cable may result in breakdown or disintegration of the insulation surrounding the cable. On the other hand, to increase insulation ratings of cables sufficiently to preclude electrical breakdown at high voltages and high temperature is expensive. The cost of insulated cable for use at voltage levels of about twenty-four kilovolts, for example, has been estimated to comprise about half of the capital cost of a proximity-effect heating system.

To improve existing proximity-effect heating systems, it would be desirable to be able to reduce the voltages required for systems of a given length, or to increase the length of a proximity-effect circuit which can be effectively energized by a given voltage. On approach for lengthening proximity-effect circuits is suggested in U.S. Pat. No. 4,523,177. According to this patent, the secondary winding of a first transformer comprises the power source for a heating circuit which includes the primary winding of a subsidiary transformer. The patentee suggests that additonal lengths of circuit can be provided by adding subsidiary transformers in series.

A method for reducing the cost of electrical insulation in proximity-effect circuits is suggested in U.S. Pat. No. 3,423,966. According to the patentee, the electrical potential between an insulated conductor and a heat-tracing pipe decreases gradually along the length of the heat-tracing pipe, and the grade of insulation utilized in the proximity-effect circuit can be decreased in a stepwise fashion corresponding to decreases in electrical potential in order to economize on insulation costs.

OBJECTS AND SUMMARY OF THE INVENTION

Generally speaking, an object of the present invention is to provide an improved method for supplying electrical energy to in-place (i.e., previously installed) proximity-effect heating circuits.

A more specific object of the present invention is to provide a method of reducing voltages required by in-place proximity-effect circuits for heating long-distance pipelines, thereby reducing the likelihood of breakdown of insulation on insulated cables utilized in the circuits.

In contrast to prior art systems, a system connected in accordance with the method of the present invention provides electrical power carried from main alternating-current source stations to feed nodes remote from the main stations; at the remote feed nodes, proximity-effect circuits run in diverging directions through heat-tracing pipes.

In accordance with the preceding, the present invention provides a method for reducing the voltage required by in-place proximity-effect circuits for heating long-distance pipelines, which in-place circuits have (1) a main transformer station including at least one secondary winding providing single-phase power, (2) a first proximity-effect heating circuit comprising a first insulated conductor connected to a first terminal of a first one of the secondary windings and extending therefrom lengthwise through a ferromagnetic heat-tracing pipe to a first remote node at which the conductor is connected to the heat-tracing pipe, and a second conductor connected between a second terminal of the first secondary winding and the heat-tracing pipe near the main transformer station. In one embodiment, the method of the invention comprising the steps of:

disconnecting the second conductor from the heat-tracing pipe and connecting the second terminal of the secondary winding externally of the heat-tracing pipe to a first location spaced substantially from the main transformer station and, at that location, making a connection to the heat-tracing pipe;

disconnecting the first insulated conductor from said first terminal of the first secondary winding and connecting said first insulated conductor to the heat-tracing pipe at a location near the main transformer station;

connecting a first uninsulated conductor between said first terminal of the first secondary winding and the first insulated conductor at a feed node location spaced substantially from the main transformer station.

In accordance with the preceding, an advantage of the present invention is to provide a reduction in the voltage required by in-place proximity-effect circuitry while still providing the same heat input to the same length of heat-tracing pipe.

More specifically, an advantage of the present invention is to reduce the likelihood of cable insulation failure and to minimize the need for upgrading cable insulation in heat-tracing system of the proximity-effect type.

The foregoing and additional advantages of the present invention will become apparent to those skilled in the art upon consideration of the accompanying specification, claims and drawings.

In the accompanying drawings, conventional components such as switches, relays, circuit breakers, contactors, temperatures controllers, sensors, and other well-known apparatus in the art of proximity-effect heating have been omitted for the sake of clarity.

DESCRIPTION OF THE PREFERRED EMBODIMENTS

Figure 1:
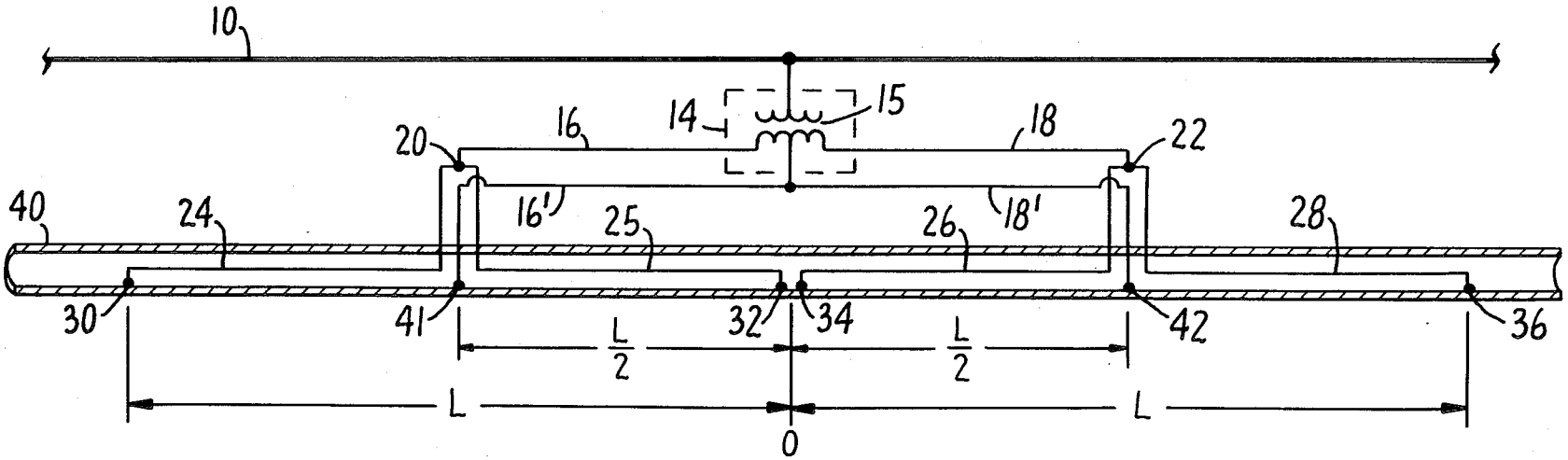
FIG. 1 is a schematic diagram of a proximity-effect circuit in accordance with the present invention.

In a proximity-effect heating system according to FIG. 1, electrical power is carried by main power transmission line 10 to main transformer station 14. The electrical power is usually 3-phase and, in practice, transmission line 10 is uninsulated and is supported by power poles running parallel to a heat-tracing pipe 40 constructed and arranged to be in heat-conducting contact with a main pipeline (not shown). Main transformer station 14 is located at a convenient point along the pipeline and there the 3-phase power is converted to single-phase power by means, for example, of one or more transformers 15 of the Scott T-type. From a secondary winding of transformer 15, lines 16 and 18 carry single-phase current to respective feed nodes 20 and 22 located remotely in opposed directions along heat-tracing pipe 40. In practice, lines 16 and 18 are uninsulated and, in the following will be referred to as uninsulated conductors even though, in actuality, a relatively inexpensive grade of insulation may be provided on those conductors. At feed node 20, conductor 16 is connected to insulated conductors 24 and 25 which extend in opposed directions lengthwise within heat-tracing pipe 40. Insulated conductor 24 connects with heat-tracing pipe 40 at a node 30 in one direction remote from feed node 20, and insulated conductor 25 connects with heat-tracing pipe 40 at node 32 in the opposite direction remote from feed node 20. Similarly, feed node 22 comprises a connection between uninsulated conductor 18 and insulated conductors 26 and 28, and the latter extend in opposite directions lengthwise within heat-tracing pipe 40 for connection to the pipe at remote points 34 and 36, respectively.

To provide a sense of relative scale to the drawings, FIG. 1 shows main transformer station 14 located at point O, and feed nodes 20 and 22 located at distances L/2 from point O. Remote nodes 30 and 36 are located at distance L from point O. Nodes 32 and 34, where respective insulated conductors 32 and 34 are connected to pipe 40, are located adjacent point O. In practice, distance L ranges from several hundred to several thousand feet.

In practice, uninsulated conductors 16 and 18 are carried to feed nodes 20 and 22 by the power poles that carry main power line 10. Also in practice, uninsulated lines 16' and 18' extend from main transformer 15 along the same power poles as lines 16 and 18, and are connected to heat-tracing pipe 40 at nodes 41 and 42, respectively, near feed nodes 20 and 22.

In operation of the proximity-effect circuit of FIG. 1, single-phase current is provided by each of the secondary windings of main transformer 15. From one of the secondary windings, current is carried via uninsulated conductor 18 to feed node 22. At feed node 22, current flows through insulated conductor 28 to remote node 36, and then flows through the wall of heat-tracing pipe 40 to node 42 to provide electrical heating of heat-tracing pipe 40 over distance L/2. From node 42, cable 18' complete the circuit back to the secondary winding of transformer 15. Also from feed node 22, electrical current flows through insulated conductor 26 to node 34 and then returns through the wall of heat-tracing pipe 40 to node 42.

The circuitry on the left-hand side of the system of FIG. 1 is essentially symmetrical with the circuitry on the right-hand side and operates in the same manner.

Figure 4:
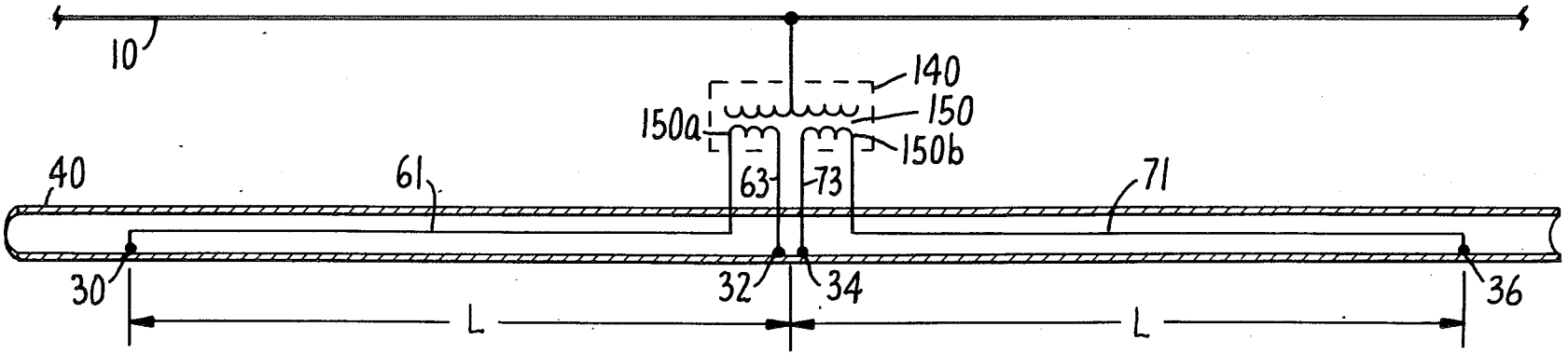
FIG. 4 is a schematic diagram of a proximity-effect circuit according to the prior art.

To illustrate some of the advantages of the circuit of FIG. 1 over the prior art, FIG. 4 shows a typical proximity-effect heat-tracing system according to the prior art. In FIG. 4, a main transformer station 140 includes a transformer 150 having secondary windings **150*a* and 150*b* which each provide single-phase power. An insulated conductor 61 is connected to a first terminal of first secondary winding 150*a* and extends lengthwise along the interior of heat-tracing pipe 40 to a connection at remote node 30. Also, a conductor 63 is connected between a second terminal of first secondary winding 150*a* and node 32 on heat-tracing pipe 40. As in the system of FIG. 1, remote node 30 is spaced from main station 140 by distance L, and node 32 is relatively close to main station 140. Further in the system of FIG. 4, an insulated conductor 71 is connected to a first terminal of second secondary winding 150*b* and extends lengthwise along the interior of heat-tracing pipe 40 to a connection at remote node 36. Conductor 73 is connected between a second terminal of second secondary winding 150*b* and node 34 on heat-tracing pipe 40. Thus, the proximity-effect circuit comprised of conductors 61 and 63 may be said to be electrically in parallel with the proximity-effect circuit comprised of conductors 71 and 73**.

Operation of the circuitry of FIG. 4 will now be described. In operation, main transformer 150 receives power on transmission line 10 and provides single-phase power on secondary windings **150*a* and 150*b*. Current from secondary winding 150*a* flows through insulated conductor 61 to remote node 30, then along the wall of heat-tracing pipe 40 to node 32, and then returns to first secondary winding 150***a* through cable 63. Likewise, current from secondary winding 150*b* flows through insulated conductor 71 to remote node 36, then passes through the wall of heat-tracing pipe 40 to node 34, and then returns to the second terminal of second secondary winding 150*b*.

In the proximity-effect circuit of FIG. 4, the potential required at insulated conductors 61 and 71 adjacent main transformer 150 is approximately twice the potential required at feed nodes 20 and 22 in the system of FIG. 1. Higher voltages are required in the system of FIG. 4 than in the system of FIG. 1 because insulated conductors 61 and 71 in the circuit of FIG. 4 each extend substantially further than each of insulated conductors 24, 25, 26 and 28 in the circuit of FIG. 1. As a consequence of the lower voltage required by the system of FIG. 1 relative to the system of FIG. 4, insulation breakdown problems are substantially reduced.

If a proximity-effect system is modified from the configuration of FIG. 4 to the configuration of FIG. 1, main transformer 15 can be readily modified to operate at lower voltages. One method of modifying transformer 15 is to reduce the turn ratios of its windings to reduce output voltages. Another method of providing reduced voltages is to utilize subsidiary step-down transformers as illustrated in the systems of FIGS. 2A and 2B.

Figure 2A:
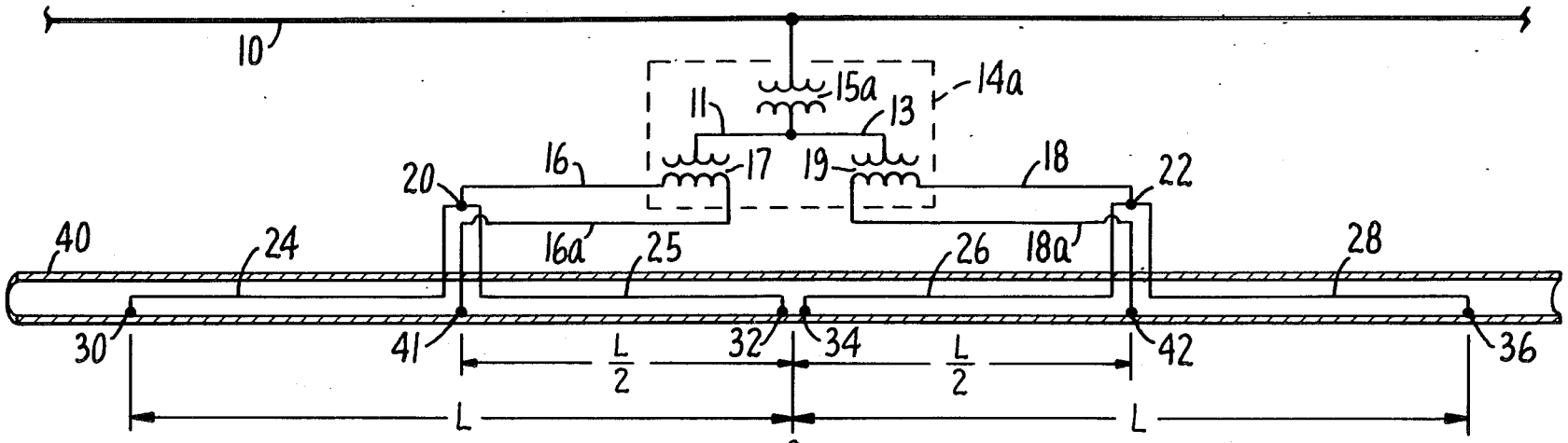
FIG. 2A is a schematic diagram of a more detailed embodiment of the proximity-effect circuit of FIG. 1.

In the system in FIG. 2A, the secondary windings of main transformer 15*a* are connected to first and second subsidiary step-down transformers 17 and 19 via lines 11 and 13, respectively, so that subsidiary step-down transformers 17 and 19 are effectively connected in parallel. In the system of FIG. 2A, transformers 15*a*, 17 and 19 are to be understood as integral to the same transformer bank and, thus, comprise a single main station 14*a*. Further in the system of FIG. 2A, the secondary winding of first subsidiary step-down transformer 17 is connected to node 20 via line 16 and to node 41 via conductor 16*a*. Similarly, the secondary winding of second subsidiary step-down transformer 19 is connected to a node 22 via line 18 and to node 42 via conductor 18*a*. Other connections in the circuit of FIG. 2A are the same as in the system of FIG. 1, and therefore, the description of such connections is not repeated.

Figure 2B:
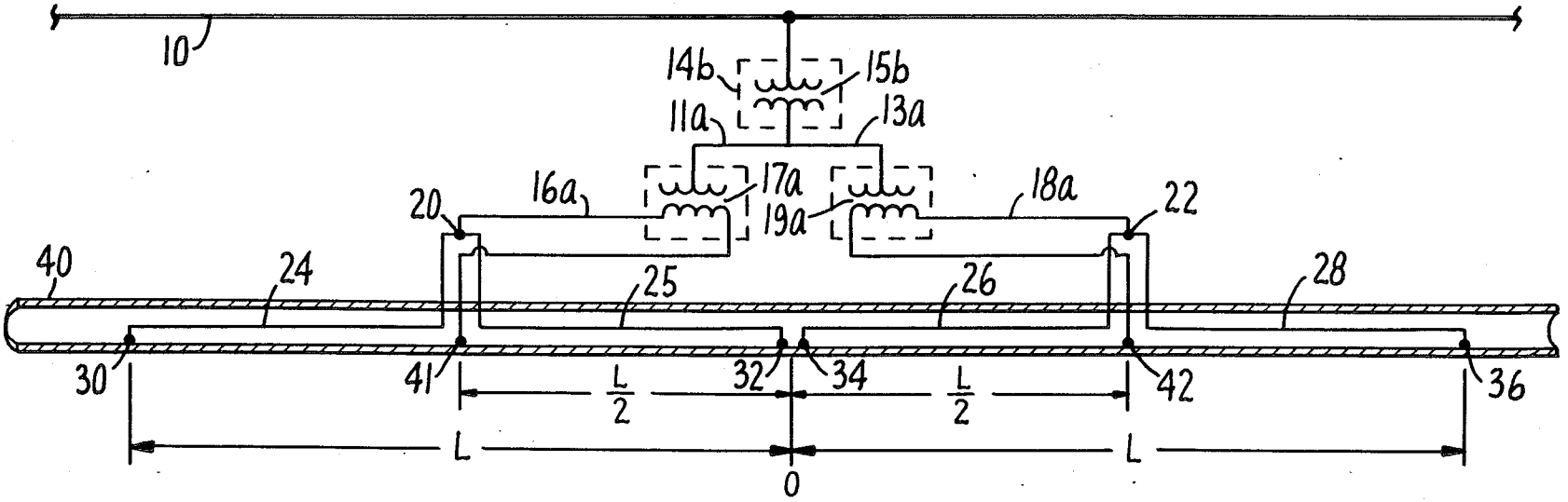
FIG. 2B is a schematic diagram of a second embodiment of a proximity-effect circuit.

Referring now to the system in FIG. 2B, a first one of the secondary windings of main transformer 15*b* at main station 14*b* is connected, via line 11*a*, to the primary winding of a first subsidiary step-down transformer 17*a* located at a first site remote from main station 14*b*. The secondary windings of transformer 15*b* are also connected, via a line 13*a*, to the primary winding of a second subsidiary step-down transformer 19*a* located at a second site remote from main station 14*b*. Preferably, first and second subsidiary step-down transformers 17*a* and 19*a* are located, respectively, near feed nodes 20 and 22. When so located, lines 11*a* and 13*a* may be uninsulated and carried by the same powder poles as carry main transmission line 10.

Further with regard to the system of FIG. 2B, the secondary winding of subsidiary transformer 17*a* is connected to feed node 20 via a conductor 16*a* and, likewise, the secondary winding of subsidiary transformer 19*a* is connected to feed node 22 via conductor 18*a*. Beyond feed points 20 and 22, the proximity-effect circuits of FIGS. 2A and 2B are essentially identical.

The proximity-effect heating systems of FIGS. 2A and 2B may now be compared and contrasted in terms of structure and function. One common feature is that the first and second subsidiary transformers in both systems are connected in parallel relative to the main transformer. That is, first and second subsidiary step-down transformers 17 and 19 of the system of FIG. 2A are connected in parallel and, likewise, first and second subsidiary transformers 17*a* and 19*a* of the system of FIG. 2B are connected in parallel. On the other hand, a distinction between the systems of the two figures is that subsidiary transformers 17 and 19 in the system of FIG. 2A are located at main staion 14*a*, whereas subsidiary transformers 17*a* and 19*a* of the system of FIG. 2B are located at sites remote from main transformer 15*b*. Thus, conductors 11*a* and 13*a* in the system of FIG. 2B are substantially longer than the conductors 11 and 13 in the system of FIG. 2A. Another distinction between the systems of FIGS. 2A and 2B is that conductors 16 and 18 in the system of FIG. 2A, are relatively long compared to conductors 16*a* and 18*a* in the system of FIG. 2B.

Figure 3:
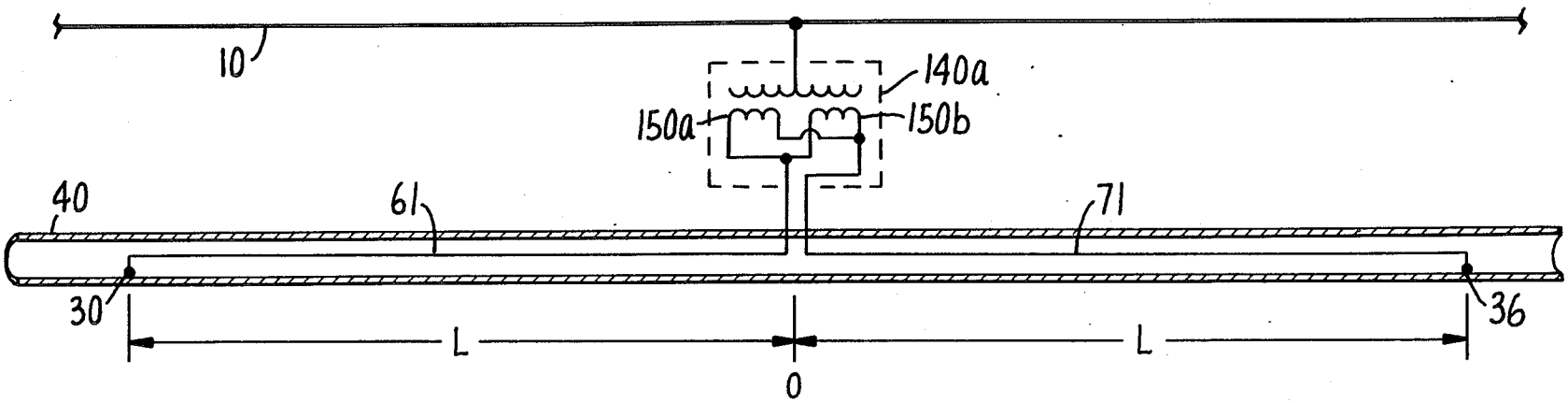
FIG. 3 is a schematic diagram of another embodiment of a proximity-effect circuit.

FIG. 3 shows another configuration in which a previously-existing proximity-effect circuit can be re-connected. In this embodiment, main transformer station 140*a* includes first and second secondary winding 150*a* and 150*b* connected in parallel. From the first terminal of first secondary winding 150*a*, insulated conductor 61 extends through the interior of heat-tracing pipe 40 to remote node 30. Similarly, insulated conductor 71 extends from the first terminal of secondary winding 150*b* through the interior of heat-tracing pipe 40 to remote node 36. The second terminal of secondary winding 150*a* is connected to the first terminal of secondary winding 150*b*, and the second terminal of secondary winding 150*b* is connected to the first terminal of secondary winding 150*a*. It should be noted that insulated conductors 61 and 71 are connected through the heat-tracing pipe 40 and, thus, can be said to be in series with one another.

Although the present invention has been described in terms of various perferred embodiments, further modifications and improvements will occur to those skilled in the art. Accordingly, it should be understood that the present invention is not limited to the particular embodiments shown, and that appended claims are intended to encompass such equivalent variations as come within the scope of the invention.

I claim:

1. A method for reducing voltages utilized by in-place proximity-effect circuits for heating long-distance pipelines, which circuits have (1) a main transformer station including at least one secondary winding providing single-phase power, and (2) a proximity-effect heating circuit including a first insulated conductor connected to a first terminal of one of said at least one secondary winding and extending therefrom internally through a ferromagnetic heat-tracing pipe to a first remote node at which the conductor is connected to the heat-tracing pipe, and a second conductor coupled between a second terminal of said at least one secondary winding and the heat-tracing pipe near the main transformer station, said method comprising the steps of:

disconnecting the second conductor from the heat-tracing pipe and connecting a first substantially uninsulated conductor externally of the heat-tracing pipe between said second terminal and a feed node location that is spaced substantially from the main transformer station generally intermediate the length of the first insulated conductor and, at that said feed node location, making a connection to the heat-tracing pipe;

disconnecting the first insulated conductor from said first terminal of said one of said at least one secondary winding and connecting said first insulated conductor to the heat-tracing pipe at a location near the main transformer station; and connecting a second substantially uninsulated conductor externally of the heat-tracing pipe between said first terminal of said one of said at least one secondary winding and the first insulated conductor at said feed node located generally intermediate the length of the first insulated conductor.

2. A method according to claim 1 wherein said feed node location is at about one-half the distance from said main transformer station to said remote node.

3. A method according to claim 1 wherein said feed node is located at the approximate mid-point of the first insulated conductor.

4. A method according to claim 1 including the step of supporting said first uninsulated conductor on power poles external to said heat-tracing pipes.

5. A method for reducing the voltage utilized by in-place proximity-effect circuits for heating long-distance pipelines, which circuits have a main transformer station including at least one secondary winding providing single-phase power, and a proximity-effect heating circuit including a first conductor connected to a first terminal of one of said secondary windings and extending internally through a ferromagnetic heat-tracing pipe to a first remote node at which the conductor is connected to the heat-tracing pipe, and a second conductor coupled between a second terminal of said secondary winding and the heat-tracing pipe near the main transformer station, said method comprising the steps of:

connecting a subsidiary step-down transformer to said secondary winding of the main transformer to reduce voltage from said winding;

disconnecting the second conductor from the heat-tracing pipe, and connecting a first substantially uninsulated conductor, externally of the heat-tracing pipe between one terminal of the subsidiary step-down transformer and a feed node location that is spaced substantially from the main transformer station generally intermediary the length of the first insulated conductor and, at that said feed node location, making a connection to the heat-tracing pipe;

disconnecting the first conductor from said first terminal of said secondary winding and connecting said first conductor to the heat-tracing pipe at a location near the main transformer station; and connecting a second substantially uninsulated conductor between a second terminal of said subsidiary step-down transformer and the first conductor at said feed node located generally intermediate the length of the first conductor.

6. A method according to claim 5 wherein said subsidiary step-down transformer is located substantially adjacent the main transformer station.

7. A method according to claim 5 wherein said subsidiary step-down transformer is located substantially adjacent said feed node.

8. A method according to claim 5 wherein said feed node is located at the approximate mid-point of the first insulated conductor.

* * * * *